United States Patent [19]

Tanaka et al.

[11] Patent Number: 4,545,193

[45] Date of Patent: Oct. 8, 1985

[54] METHOD FOR PIECING FASCIATED YARN

[75] Inventors: Akira Tanaka; Kazuo Seiki, both of Kariya; Haruyoshi Nakamura, Obu, all of Japan

[73] Assignee: Kabushiki Kaisha Toyoda Jidoshokki Seisakusho, Aichi, Japan

[21] Appl. No.: 599,761

[22] Filed: Apr. 13, 1984

[30] Foreign Application Priority Data

Apr. 15, 1983 [JP] Japan ..... 58-65604
May 11, 1983 [JP] Japan ..... 58-80785

[51] Int. Cl.[4] ..... D01H 15/00; D01H 5/28

[52] U.S. Cl. ..... 57/261; 57/22; 57/263; 57/328

[58] Field of Search ..... 57/22, 261, 263, 328, 57/333

[56] References Cited

U.S. PATENT DOCUMENTS

| | | | |
|---|---|---|---|
| 3,821,878 | 7/1974 | Parsons | 57/263 |
| 3,992,865 | 11/1976 | Tuchida et al. | 57/328 |
| 4,023,336 | 5/1977 | Krusche et al. | 57/263 |
| 4,053,662 | 3/1985 | Horiuchi et al. | 57/261 |
| 4,438,621 | 3/1984 | Rohner | 57/333 X |
| 4,485,615 | 12/1984 | Pigalev et al. | 57/261 |

*Primary Examiner*—Donald Watkins
*Attorney, Agent, or Firm*—Burgess, Ryan & Wayne

[57] ABSTRACT

A method for yarn piecing in a fasciated yarn spinning unit, in which a yarn portion to be pieced is always nipped by a piecing roller means during the piecing operation, whereby feeding length and speed of the yarn in the piecing operation can be accurately controlled by the piecing roller means. Thus, a complicated restarting operation can be carried out in accordance with a predetermined time schedule.

6 Claims, 25 Drawing Figures

METHOD FOR PIECING FASCIATED YARN

BACKGROUND OF THE INVENTION

1. Field of the Invention

The present invention relates to a method for piecing a fasciated yarn. More specifically, it relates to a method for piecing a yarn end to a fiber bundle in a fasciated yarn spinning unit when the yarn breaks during the spinning operation.

2. Description of the Prior Art

In a fasciated yarn spinning unit, a fiber bundle of a ribbon-like shape (hereinafter referred to as a fleece) delivered from a front roller pair of a drafting means is sucked into an air nozzle disposed just downstream of the front roller pair. The fleece is false-twisted in the air nozzle by a vortex generated therein and is converted to a so-called fasciated yarn. This spinning system is very advantageous because it can run at a much higher rate of 100 m/min, compared to a conventional spinning system such as ring spinning or open-end spinning.

A problem has arisen in this spinning system in that the yarn is difficult to be pieced when it has broken during the spinning operation, because of a compact structure of the yarn due to the entanglement of a surface fiber around a core portion of the yarn as well as of a high processing speed, and thereby, it is almost impossible to piece the broken end of the yarn to a freshly delivered fleece by merely overlapping them together in the twisting zone. Thus, it is necessary to reversely guide the broken end through the air nozzle into the drafting means so as to overlap it on the fleece in a drafting zone. This is referred to as "threading" hereinafter. Thereafter, the overlapped portion is twisted by the vortex in the air nozzle while passing again therethrough, whereby the fleece can be entangled around the yarn end to complete the piecing.

Length of the overlapped portion has a substantial effect on the result of piecing. That is, if the length of the overlapped portion is too long, a so-called "ballooning" tends to occur in the air nozzle due to a centrifugal force exerted on this portion during twisting operation, whereby the yarn is forced to touch the inner wall of the air nozzle resulting in increase of resistance against yarn passing and, in turn, failure of yarn piecing. Even if it succeeds, the resultant yarn may be of low quality due to a longer pieced portion. On the other hand, if the length of the overlapped portion is too short, the yarn breakage also occurrs due to insufficient entanglement of the fleece to the yarn end. Accordingly, it is important for improving the sucess rate of yarn piecing to prepare a proper length of the overlapped portion in the drafting zone.

In principle, the abovesaid length of the overlapped portion can be controlled by adjusting a time for restarting the fleece held stationarily in the drafting means in relation to that for rewinding the yarn to the package. However, since the processing speed of the fasciated yarn spinning is very high as stated before, such that the adjustment of timing is very difficult. Moreover, the winding speed of the yarn in the early stage of rewinding tends to vary depending on the size of the package, whereby a precise control of the timing is hardly achievable.

SUMMARY OF THE INVENTION

It is an object of the present invention to provide a novel method for yarn piecing in a fasciated yarn spinning system which can resolve the abovesaid problem.

It is another object of the present invention to provide a method for yarn piecing in a faciated yarn spinning unit in which yarn tension in an air nozzle is accurately controllable when a yarn to be pieced is entangled to a fiber bundle.

It is a further object of the present invention to provide a method for yarn piecing in a fasciated yarn spinning unit by which a resultant yarn with a pieced portion having an overlapped length suitable for maintaining proper yarn strength as well as harmless to total yarn quality can be obtained.

These objects are achievable by a method for piecing a broken end of a yarn with a fiber bundle in a fasciated yarn spinning unit, said unit comprising a drafting means including a back roller pair and a front roller pair and an air nozzle for twisting the fiber bundle by a vortex to form a fasciated yarn, comprising steps of;

a. guiding a yarn to be pieced to an outlet of the air nozzle while nipping it by a displaceable piecing roller means, b. reversely introducing the yarn into the drafting means through said air nozzle and the front roller pair while controlling yarn length by reverse directional rotation of said piecing roller means;

c. withdrawing the yarn from the outlet of the air nozzle by normal directional rotation of the piecing roller means while overlapping the fiber bundle on the yarn at the nip point of the front roller pair, the withdrawing speed being controlled to synchronize with the delivery speed of the front roller pair, and, d. generating said vortex in the air nozzle to twist the overlapped portion.

In the preferred embodiment, the air nozzle is displaceable to a threading position for enhancing the threading operation.

Further, the piecing roller means is preferably engageable with the air nozzle for fixing the relative position thereof during the piecing operation.

These and other objects of, and many of the advantages of, the present invention will be better understood with reference to the following detailed description taken in connection with the accompanying drawings.

BRIEF DESCRIPTION OF THE DRAWINGS

FIGS. 4A to 4H show steps of threading operation according to one aspect of the present invention in which FIGS. 4A and 4B are schematic side views of a fasciated yarn spinning unit and FIGS. 4C to 4H shows front views thereof;

DESCRIPTION OF THE PREFERRED EMBODIMENTS

Figure 1:
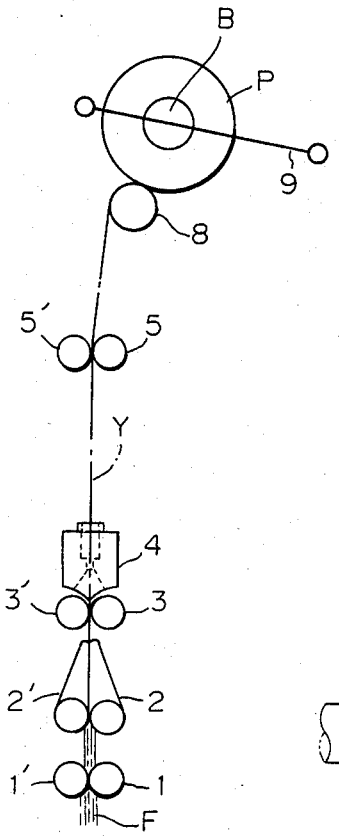
FIG. 1 is a schematic side view of a fasciated yarn spinning unit in operation.

In a fasciated yarn spinning unit shown in FIG. 1. an air nozzle 4 is disposed downstream of a drafting means. The drafting means comprises pairs of back rollers 1, 1', middle aprons 2, 2', and front rollers 3, 3'. Here, reference numerals 1, 2, and 3 designate bottom side elements positively driven and 1', 2', and 3' designate top side elements driven by former elements. The drafting means is so devised that the back roller 1 can stop or start irrespective of the other elements 2 and 3 by, for example, a clutch means (not shown). Downstream of the air nozzle 4 are arranged a draw-off roller pair 5, 5' and a take-up drum 8 along a yarn passage. A fiber bundle F fed to the drafting means is attenuated therein at a predetermined drafting ratio and is delivered from the front roller pair 3, 3' as a fleece. The fleece is immediately sucked into the air nozzle 4 through an inlet 4*a* thereof by a suction caused by a vortex whirling therein. Passing through the air nozzle 4, the fleece is twisted by the vortex and converted to a fasciated yarn Y. The yarn Y, then, is drawn out from an outlet 4*b* of the air nozzle 4 by the draw-off roller pair 5, 5' and is wound on a bobbin B rotatably supported by an arm 9 and driven by a take-up drum 8. Thus, a yarn package P is formed.

Figure 2:
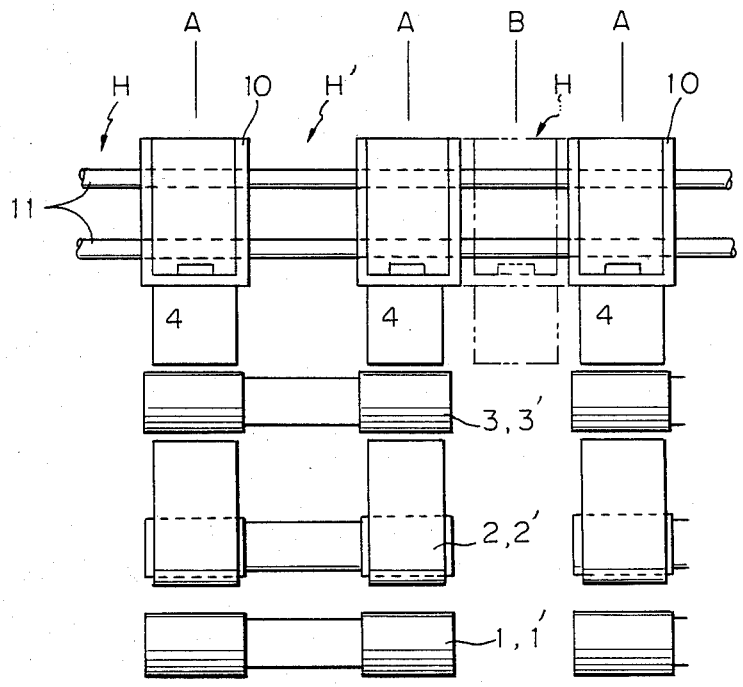
FIG. 2 is a schematic plan view of a group of two fasciated yarn spinning units showing a displaceable air nozzle and a space between two adjacent groups.

The spinning units thus described are arranged on a spinning frame parallel to each other with a predetermined space therebetween. According to a preferred embodiment of the present invention, every adjacent two spinning units form one group having common drafting means so that a free space H is formed between every groups, as shown in FIG. 2. The air nozzle 4 is normally disposed in a position A when the spinning operation is carried out. However, when the yarn piecing operation is carried out, it is displaced to a position B within the free space H. According to this displacement, the air nozzle 4 can escape from the position in front of the front roller pair 3, 3', thereby a space sufficient for the piecing operation is prepared.

Figure 3:
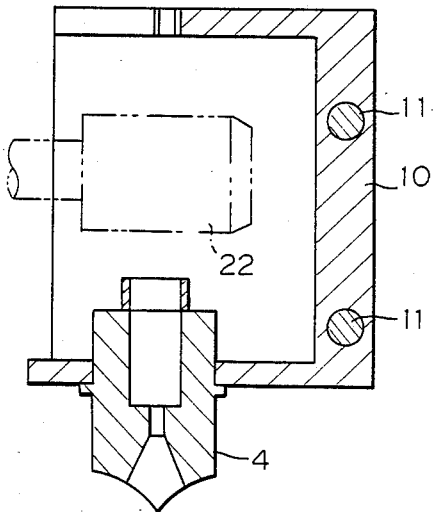
FIG. 3 is a side sectional view of an air nozzle fixed to a holder thereof.

For enhancing this displacement, the air nozzle 4 is provided with a holder 10 on its body. The holder 10 is slidably engaged on two stationary guide rods 11 arranged parallel to an axis of the front pair 3, 3' through apertures provided on side walls of the holder 10, as shown in FIGS. 2 and 3. In FIG. 3, a chain line depicts a position of a piecing roller 22 in the united condition, as described later.

Figure 4A:
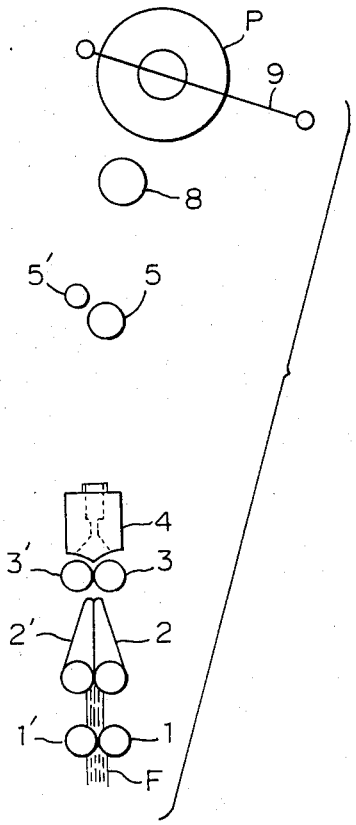

When a yarn breakage occurs during the spinning operation, the package P is detached from the take-up drum 8 by a known push-up mechanism for the arm 9 (not shown). On the other hand, in the drafting means, only the back roller pair 1, 1' is stopped at once while the other pairs 2, 2' and 3, 3' continue to rotate, whereby the fleece F is torn in a drafting zone between the back roller pair 1, 1' and the second apron pair 2, 2' with its leading end closely facing the latter (FIG. 4A).

The yarn breakage signal is transmitted to yarn piecer patrolling around the spinning frame along a rail arranged in front thereof. The yarn piecer stops in front of the faulty unit in a known manner, and the piecing operation then starts.

Figure 4B:
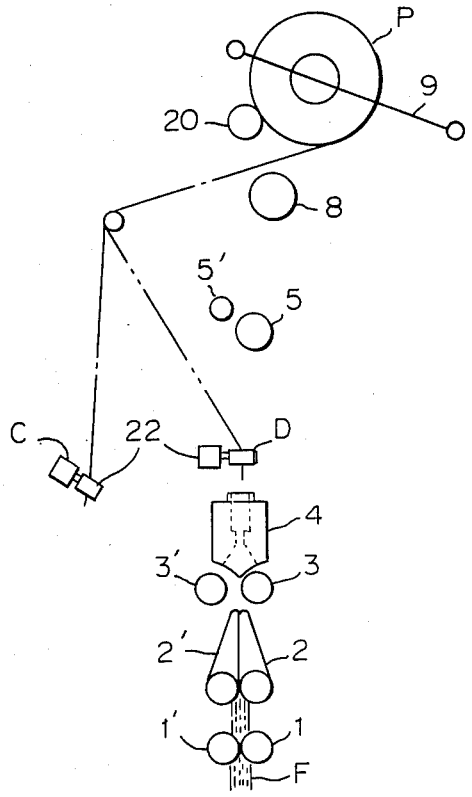
Figure 5:
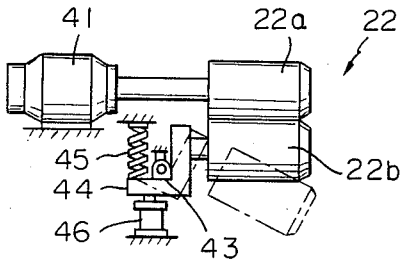
FIG. 5 is a plan view showing a construction of a piecing roller.

The package P detached from the drum 8 is supported by a known package driving roller 20 provided on the yarn piecer, as shown in FIG. 4B. The package driving roller 20 has a function to rotate the package P in the normal or reverse direction. First, the broken end of the yarn is picked up from a package surface with a known pick-up mechanism (not shown) during the reverse rotation of the package P by the package driving roller. Then, the broken end is transferred to a guiding means such as a piecing roller means 22 in a waiting position C and nipped thereby, as shown in FIG. 4B. In FIG. 5, it comprises a driving roller 22*a* connected to a motor 41 and a pressing roller 22*b* rotatably secured on a L-shaped member 44. The L-shaped member 44 is hinged to a frame of the roller means 22 (not shown) by a pin 43 and is biased by a compression spring 45 so that the pressing roller 22*b* is urged onto the driving roller 22*a*. The L-shaped member is also engaged to an actuator of a solenoid 46 to overcome the bias of the spring 45 when the solenoid 46 is energized, and to detach the pressing roller 22*b* from the driving roller 22*a*. According to this structure, the yarn can be inserted into or removed from a gap between the two rollers 22*a* and 22*b* when detached, and can be nipped therebetween when engaged. Under the nipped condition, the yarn can be fed normally or reversely corresponding to the rotational direction of the driving roller 22*a*.

Figure 6:
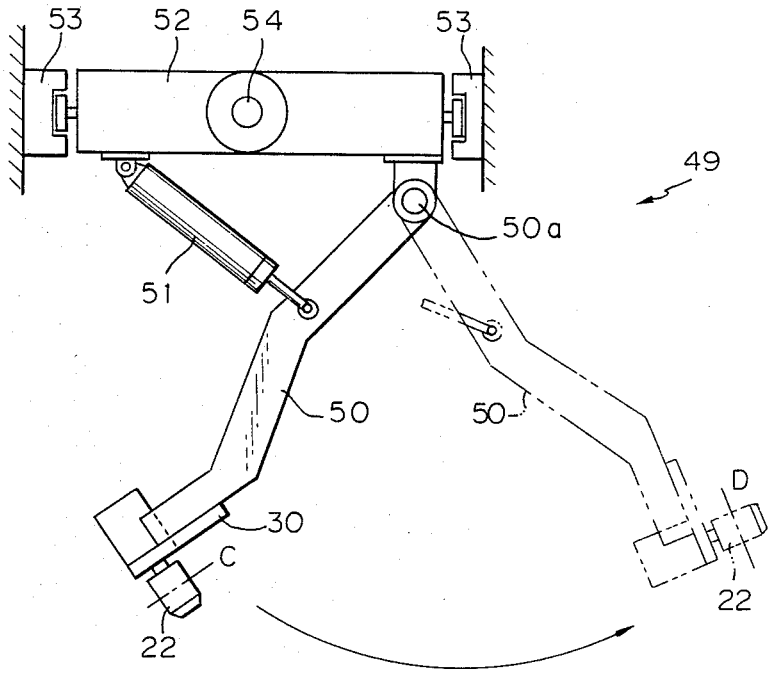
FIG. 6 is a side view of a displacement mechanism for a piecing roller means.

The piecing roller means 22 is mounted on an outer end of an arm 50 of a displacing mechanism 49 secured on the yarn piecer as shown in FIG. 6. The arm 50 can pivot around a pin 50*a* with a predetermined angle by the action of an air cylinder 51, thereby the piecing roller means 22 is displaceable from the above waiting position C to another position D in a plane parallel to the plane of the paper of the drawing at which position the piecing roller means 22 is united to the air nozzle 4 in the normal spinning position A, as stated later. Both the arm 50 and the air cylinder 51 are mounted on a carrier 52 supported by a pair of rails 53 in such a manner that it is movable along the latter by means of an air cylinder 54 in a plane perpendicular to the plane of paper of the drawing. This perpendicular displacement of the carrier 52 causes the aforesaid displacement of the air nozzle 4 from the position A to B.

As described above, the piecing roller means 22 receiving the broken end of the yarn is moved from the waiting position C to the position D corresponding to the position A of the air nozzle 4 as shown in FIG. 4B. At the position D, the piecing roller means 22 meets with the air nozzle 4 and is united one to the other so that the relative position of the two is fixed for facilitating the threading operation.

Figure 7:
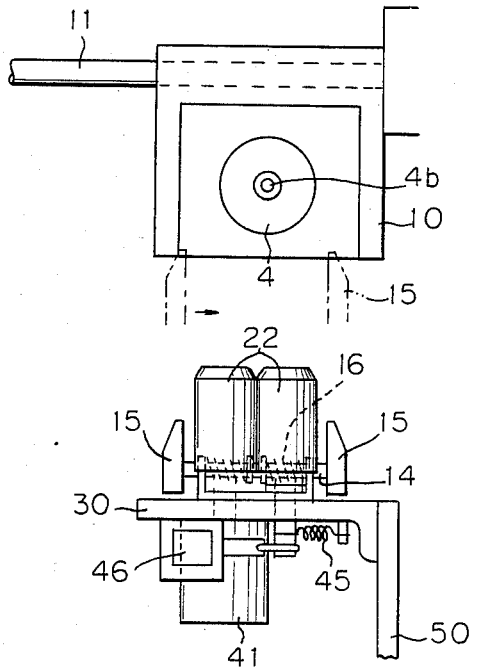
FIGS. 7 and 8 are plan views showing a uniting operation of an air nozzle and piecing roller means.
Figure 8:
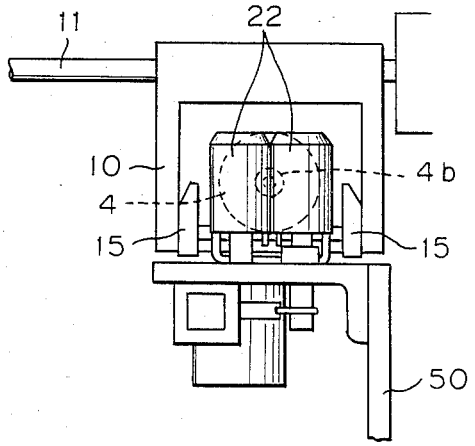

The mechanism for union of the two is described with reference to FIGS. 7 and 8, as follows.

The piecing roller means 22 is provided with a bracket 30 through which a stud 14 is loosely inserted. Positioning members 15, 15 are secured on opposite ends of the stud 14. The distance between the outer edges of positioning members 15, 15 corresponds to the inner width of the holder 10 of the air nozzle 4. Thus, as shown in FIG. 7, when the piecing roller 22 approaches to the air nozzle 4 disposed in the position A, the positioning members 15, 15 are inserted into the holder 10 and are closely engaged with the inner wall of the latter. At the final stage (in FIG. 8), the outlet 4*b* of the air nozzle 4 coincides with a nip line of the piecing roller means 22.

Fluctuation of the relative position of the air nozzle 4 and the piecing roller means before uniting causes no problem if it is within a predetermined range, because the positional error can be corrected at the final stage by a tapered structure of the positioning member 15 and a spring 16 supporting the stud 14, so as to allow a lateral movement of the stud 14.

Now, the piecing roller means 22 has been connected to the air nozzle 4 and the preparation for threading operation has been completed as shown in FIG. 4B.

Then, the air nozzle 4 is displaced along the guide rods 11 from the normal spinning position A to the threading position B, according to the mechanism described before. Due to this displacement, the inlet 4*a* of the air nozzle 4 is brought into the free space H.

Figure 4C:
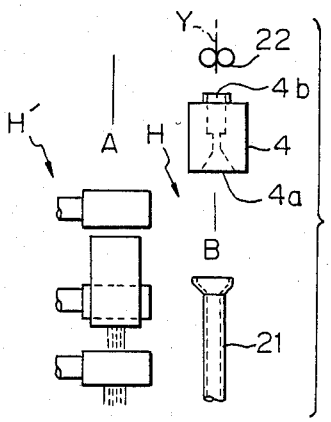

As shown in FIG. 4C, in front of the inlet 4*a* of the air nozzle 4 in this position is disposed a suction means such as a suction tube 21 connected to a suction source (not shown) movable toward the air nozzle 4 from its waiting position along the extension of the nozzle axis. This suction tube 21 can be designed to provide a powerful suction force sufficient to thread the yarn from the outlet 4*b* to the inlet 4*a* of the air nozzle 4, because the size of the tube 21 is not restricted by the parts of the spinning unit.

Figure 4D:
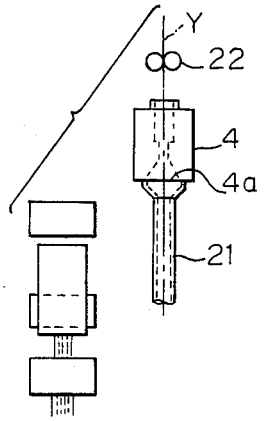

When the suction tube 21 is in close contact with the inlet 4*a* of the air nozzle 4, the piecing roller means 22 is reversely rotated in synchronism with the package driving roller 20, to reversely feed the yarn from the package P. Due to the suction force of the suction tube 21, the yarn from the package P is introduced into the air nozzle 4 and sucked into the suction tube 21 as the reverse rotation of the piecing roller means 22. After the predetermined length of the yarn is reserved in the suction tube 21, the rotation of the piecing roller means 22 and the package roller 20 is stopped (FIG. 4D). It is necessary to control the reverse rotation of the piecing roller means 22 so that an excess length of the yarn is not reserved, in order to facilitate a transferring operation of the yarn from the suction tube 21 to an intermediate yarn holding means, as described later.

Figure 4E:
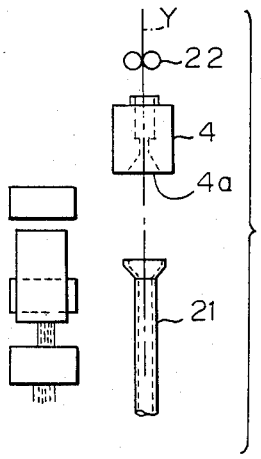

Then, the suction tube 21 moves backward to the waiting position while exposing part of the reserved yarn between a mouth thereof and the inlet 4*a* of the air nozzle 4, as shown in FIG. 4E.

In the vicinity of the exposed yarn, an intermediate yarn holding means such as a yarn holding pipe 28 connected to a suction source (not shown) is arranged on the yarn piecer. The yarn holding pipe 28 is positioned substantially perpendicular to the exposed yarn and is displaceable toward the drafting means of the spinning unit while crossing the exposed yarn. Also, the yarn holding pipe 28 is sized to be small enough to be able to enter into a narrow space in the drafting means.

Figure 4F:
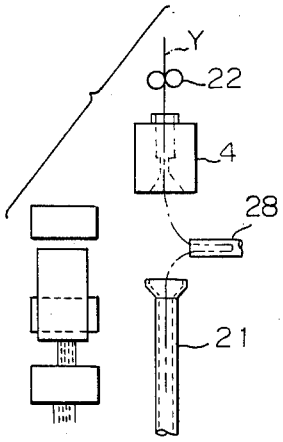

Under such condition, the yarn holding pipe 28 moves slightly forward to contact the yarn and the midportion of the yarn is sucked into the yarn holding pipe 28 (see FIG. 4F). As the yarn is sucked into the yarn holding pipe 28, the reserved yarn in the suction tube 21 is drawn out therefrom. Since the suction force on the yarn is generally proportional to the yarn length, the force of the suction tube 21 is gradually weakened and, contrary to this, that of the yarn holding pipe 28 is gradually strengthened. Thus, the reserved yarn in the suction tube 21 is smoothly and completely transferred to the yarn holdig pipe 28, as shown in FIG. 4G, even if the latter is small in size.

After the yarn transferrig operation has been completed, a predetermined further length of the yarn from the package P is fed by the reverse rotation of the piecing roller means 22 into the yarn holding pipe 28. This yarn length is necessary for the restartig operation described later and is accurately controlled by counting the rotation of the piecing roller means 28.

The next step is the insertion of the yarn between a front roller pair 3, 3'. The front roller pair 3, 3' has been kept in a condition in a known manner wherein the top side element 3' is detached from the bottom side element 3, as shown in FIG. 4B. The air nozzle 4 now threaded moves back from the threading position B to the normal spinning position A while being united with the piecing roller means 22 by means of the displacing mechanism 49. In synchronism with this returning operation of the air nozzle 4, the yarn holding pipe 28 also moves in the same direction as the movement of the air nozzle 4 toward the drafting means so that the yarn is inserted into the gap between the front roller pair 3, 3', as shown in FIG. 4H. Thus, the threading operation is completed.

Figure 4G:
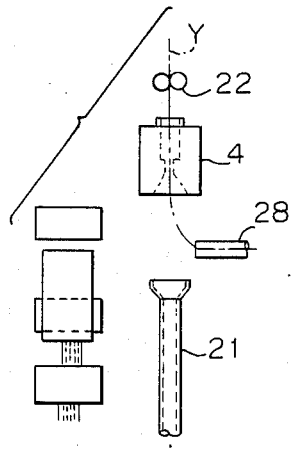
Figure 4H:
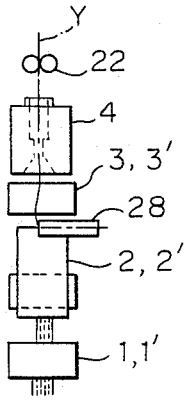
Figure 9A:
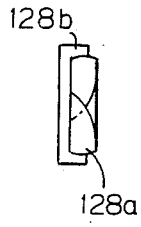
FIGS. 9A and 9B are front and plan views of a movable yarn guide, respectively.
Figure 9B:
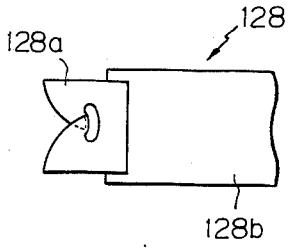
Figure 10A:
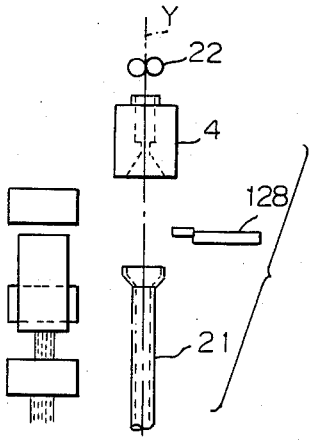
FIGS. 10A and 10B are schematic side views showing steps of a further aspect of threading operation utilizing a movable yarn guide.
Figure 10B:
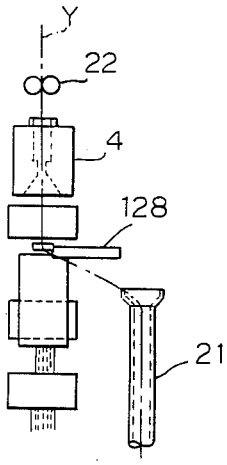

According to another aspect of the present invention shown in FIGS. 9A, 9B, 10A and 10B, the yarn transferring operation from the suction tube 21 to the yarn holding pipe 28 shown in FIGS. 4F and 4G, can be omitted. That is, in this aspect, a movable yarn guide 128 is utilized instead of the yarn holding pipe 28. The yarn guide 128 has a guide member 128*a* on its front end made of anti-abrasive material such as ceramics, as shown in FIGS. 9A and 9B. The yarn guide is displaceable toward the drafting means across the yarn held by the suction tube 21. Corresponding to the returning movement of the air nozzle 4 from the position B to A after the yarn is threaded, the yarn guide 128 displaces laterally toward the drafting means. On the way, it catches the yarn with the guide member 128*a* and brings it into the drafting means, as shown in FIGS. 10A and 10B.

Next, the restarting operation will be explained. As stated before, the time schedule of the restarting operation seriously effects on the possibility of success and quality of the yarn piecing. According to the present inventors' study, the restarting has to be sequentially carried out in accordance with the time schedule illustrated on FIG. 11 which will be explained more specifically with reference to FIGS. 12A to 12E.

Figure 12A:
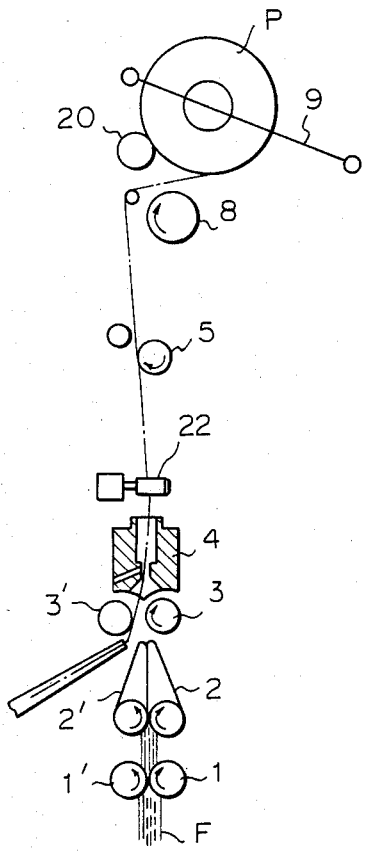
FIGS. 12A to 12E are schematic side views showing steps of restarting operation carried out in accordance with the time schedule of FIG. 11.

When the abovesaid threading operation has been completed, the spinning unit is of the state as shown in FIG. 12A (this figure corresponds to FIG. 4H already described). That is, the fleece remains between the back roller pair 1, 1' and the middle apron pair 2, 2' with its leading end closely facing the latter pair and the broken end of the yarn is held in the yarn holding pipe 28 while the downstream portion of the yarn is nipped by the piecing roller means 22 and lies through a gap between the front roller pair 3, 3' which are kept in disengaged state from each other. In FIGS. 12A to 12E, arrows marked to roller means indicate that they are operating in the designated direction.

Figure 11:
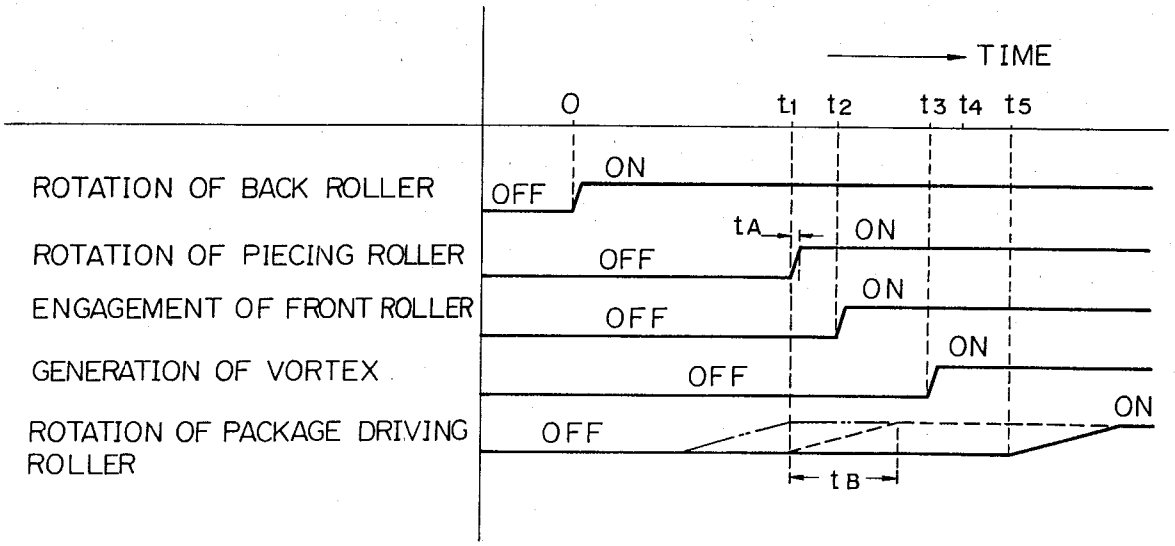
FIG. 11 is a time schedule of restarting operation according to one aspect of the present invention.

As illustrated in FIG. 11, first, the clutch means attached to the back bottom roller 1 is operated at time 0 to rotate the back roller pair 1, 1'. Thereby, the fleece F is advanced to the active zone of the middle apron pair 2, 2' and, then, to the front roller o pair 3, 3' at time $t_4$.

Figure 12B:
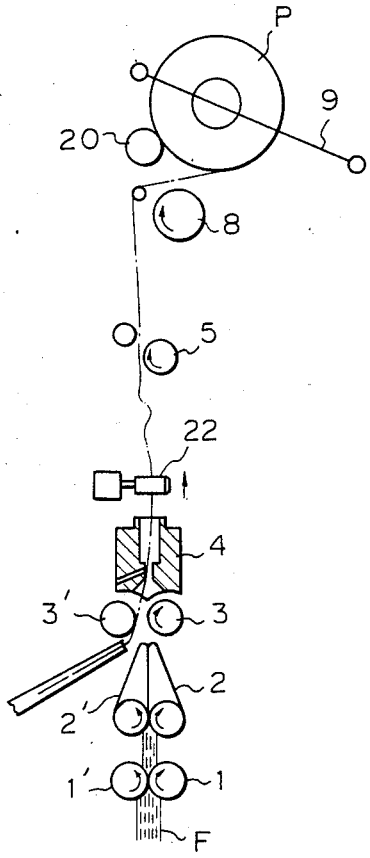

Before the fleece reaches the front roller pair 3, 3', the piecing roller means 22 begins to rotate in the normal direction at time $t_1$, whereby the reserved yarn in the yarn holding pipe 28 is withdrawn through the air nozzle 4 as shown in FIG. 12B.

Figure 12C:
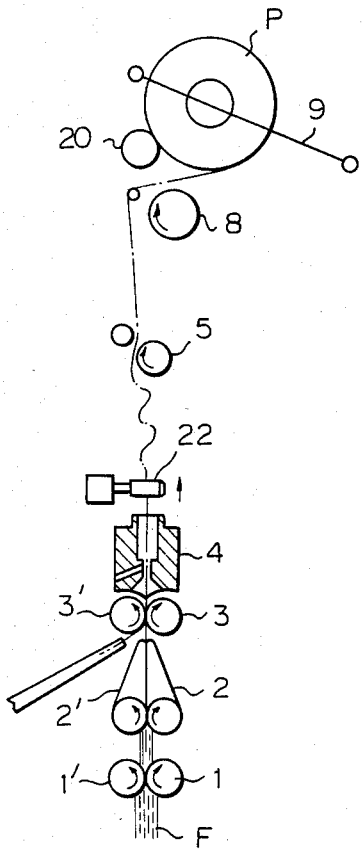

Simultaneously with or slightly later than the time $t_1$, the top side element 3' of the front roller pair 3, 3' is engaged with the bottom side element 3 at a time $t_2$ whereby the yarn portion is also positively fed by the front roller pair 3, 3'. As the linear speeds of the piecing roller means 22 and the front roller pair 3, 3' are controlled to synchronize with each other (for example, the former speed may be slightly lower than the latter to form a predetermined overfeed condition between the two), the tension of the yarn portion passing through the air nozzle 4 can be maintained at a predetermined level. This state is shown in FIG. 12C.

Figure 12D:
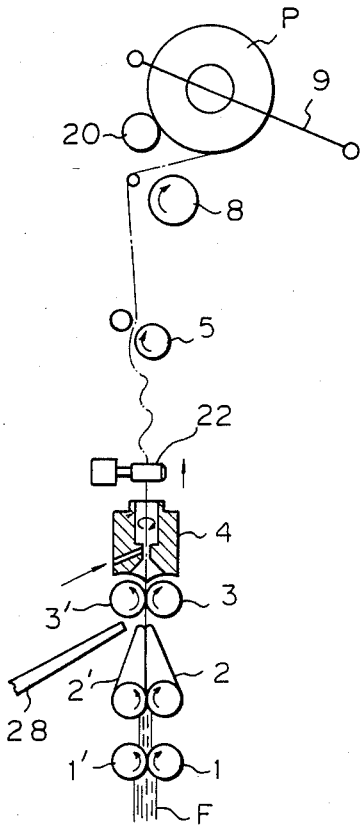

Simultaneously with or slightly later than the time $t_2$, the air jet is ejected into the air nozzle 4 at a time $t_3$ to generate a vortex as shown in FIG. 12D.

The time schedule is determined so that the abovesaid operations are completed just before the time $t_4$. The fleece reaching the front roller pair 3, 3' is drafted at a normal drafting ratio between the middle apron pair 2, 2' and the front roller pair 3, 3' and, then, is delivered from the front roller pair 3, 3' while being overlapped with the yarn portion. The fleece overlapped with the yarn portion is immediately introduced into the air nozzle 4 and is twisted by the vortex already generated therein. As the yarn tension in the air nozzle is kept at a suitable level as stated before, the fleece and the yarn are entangled to each other to complete a piecing.

Figure 12E:
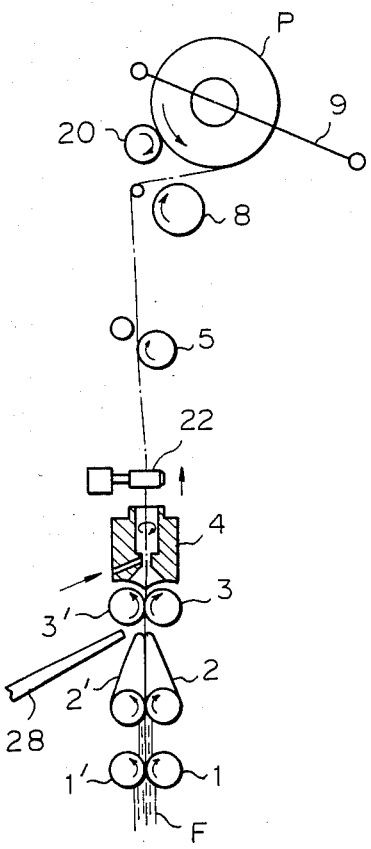

At the final stage, the package driving roller 20 begins to rotate in the normal direction at a time $t_5$ (FIGS. 11 and 12E). Thus, the package P is accelerated to take up the yarn staying in the slack condition downstream of the piecing roller means 22. After attaining the normal take-up speed, the package P is transferred from the package driving roller 20 to the take-up drum 8. At the same time, the piecing roller means 22 releases the nip of the yarn and the draw-off roller pair 5, 5' engages to each other to positively withdraw the yarn from the air nozzle 4. Thus, the normal spinning operation is started again as shown in FIG. 1.

To decrease the yarn slack between the piecing roller means 22 and the package driving roller 20 during the abovesaid restarting operation, the time $t_5$ for starting the package driving roller 20 may be determined to be the same time with or even prior to the time $t_1$ for starting the piecing roller means 22 as shown by a dotted line and a chain line, respectively, in FIG. 4. Particularly, in the latter case, it is important to take into consideration the difference of transient time durations for attaining the final speed between the package driving roller 20 and the piecing roller means 22. That is, the transient time duration $t_B$ of the package driving roller 20 is longer than that $t_A$ of the piecing roller means 22 due to the difference between loads burdened thereon, respectively. Therefore, if the time $t_5$ is determined to be earlier than the time $t_1$ by $t_B - t_A$, the yarn slack scarcely appears during the restarting operation.

In the abovesaid time schedule, the time $t_2$ for engaging the top side element 3' to the bottom side element 3 of the front roller pair, must be earlier than the time $t_4$ at which the fleece reaches the front roller pair 3, 3'. If the time $t_2$ is set later than the time $t_4$, the fleece cannot be normally attenuated by the front roller pair 3, 3' and the thicker fleece is introduced into the air nozzle 4 whereby the yarn passage in the air nozzle 4 is clogged. The time $t_1$ for starting the piecing roller means 22 must be the same as or slightly earlier than the time $t_2$. If not, the yarn delivered from the front roller pair 3, 3' cannot be introduced into the air nozzle 4 and remains in front thereof. The time $t_3$ for ejecting the air jet into the air nozzle 4 must be later than the time $t_2$. If not, all the reserved yarn is at once withdrawn from the yarn holding pipe 28 by a suction force generated in the air nozzle 4 due to the vortex generated therein, whereby the succeeding piecing steps cannot be carried out. Therefore, the times for each steps of the restarting operation must be ordered as the following equation:

$$t_1 \leqq t_2 \leqq t_3 < t_4$$

Such the time schedule is memorized in a computer for controlling the piecing operation and commands are sequentially output from the computer in accordance with the time schedule to operate the driving means for respective elements.

A duration from the time 0 for starting the back roller pair 1, 1' to the time $t_4$ at which the leading end of the fleece reaches the front roller pair 3, 3' is naturally decided by a distance $L_1$ from the leading end of the fleece to the nip point of the front pair 3, 3' and a surface speed of the front roller pair 3, 3'. According to an example in which $L_1 = 50$ mm, main draft between the middle apron pair and the front roller pair = 30 and the surface speed of the front roller pair = 150 m/min, the abovesaid duration is about 600 mS.

Further, a yarn length $L_2$ to be delivered from the piecing roller means or the front roller pair prior to twisting by the vortex can be preliminarily calculated from the time $t_1$, $t_2$, $t_3$ and $t_4$ listed on the time schedule. Therefore, the yarn length to be reserved in the yarn holding pipe 28 also can be determined as a sum of the abovesaid length $L_2$ and a length $L_3$ of the yarn portion overlapped with the fleece. According to a preferred embodiment, $L_2$ is about 200 mm and $L_3$ is about 80 mm.

As stated above, according to the present invention, the yarn to be pieced is always nipped by the piecing roller means during the piecing operation. Therefore, yarn length to be reserved in the yarn holding pipe or the yarn guide and to be withdrawn therefrom or the withdrawing speed thereof can be precisely controlled by the rotation of the piecing roller means.

According to the present invention, since the tension of the yarn portion passing through the air nozzle is controlled in a suitable level by the cooperation of the piecing roller means and the front roller pair during the restarting operation, the fleece overlapped with the yarn portion is sufficiently twisted with a large spiral angle around the latter to form a good piecing. Further, since the yarn withdrawing speed is always constant, the delivery length of the yarn can be accurately estimated, whereby the control of the time schedule of the piecing operation is easily attainable even if it must be carried out in a very short time duration.

As for the threading operation, in this specification, description is mainly made to an embodiment utilizing a displaceable air nozzle. However, the present invention is not limited to be carried out along with such the threading operation but can be utilized with the threading operation described, for example, in Japanese Unexamined Patent Publication (Kokai) No. 53-35033 in which the air nozzle is stationary and has inclined jets in an inner wall thereof for reversely introducing the yarn from outlet to inlet of the air nozzle for threading.

We claim:

1. A method for piecing a broken end of a yarn with a fiber bundle in a fasciated yarn spinning unit, said unit comprising a drafting means including a back roller pair and a front roller pair for attenuating the fiber bundle and an air nozzle for twisting the fiber bundle by a vortex to form a fasciated yarn, comprising steps of:

a. guiding a yarn to be pieced to an outlet of said air nozzle while nipping it by a displaceable piecing roller means;

b. reversely introducing the yarn into said drafting means through said air nozzle and the front roller pair while controlling the introduced yarn length by reverse directional rotation of said piecing roller means;

c. withdrawing the yarn from the outlet of said air nozzle by normal directional rotation of said piecing roller means while overlapping the fiber bundle on the yarn at the nip point of the front roller pair, the withdrawing speed being controlled to synchronize with the delivery speed of said front roller pair; and d. generating the vortex in said air nozzle to twist the overlapped portion.

2. A method according to claim 1, in which said air nozzle is displaceable between two positions, one being a normal spinning position and the other being a threading position, and further comprising two steps of a-1. between steps a and b, displacing said air nozzle from the normal spinning position to the threading position, and b-1. between steps b and c, returning said air nozzle to the normal spinning position.

3. A method according to claim 1, in which a relative position of said air nozzle and said piecing roller means is fixed during the piecing operation.

4. A method according to claim 1, in which a predetermined length of yarn is reserved as a result of step b for the preparation of the succeeding steps.

5. A method according to claim 1, in which said step c is carried out by the following sequence:

i. starting normal directional rotation of said back roller pair so that a leading end of the fiber bundle is forwarded to said front roller pair;

ii. starting normal directional rotation of said piecing roller means; and iii. engaging the elements of said front roller pair to each other, wherein the steps ii and iii are carried out before the leading end of the fiber bundle reaches said front roller pair as a result of step i.

6. A method according to claim 1, further comprising, after step d, a step of:

e. rotating a package driving roller which rotatably hold a yarn package.

* * * * *